United States Patent [19]

Berlese

[11] Patent Number: 4,587,749

[45] Date of Patent: May 13, 1986

[54] VENTED MOTORCYCLE BOOT

[76] Inventor: Remo Berlese, 31036 Sala D'Istrana, Treviso, Italy

[21] Appl. No.: 675,813

[22] Filed: Nov. 28, 1984

[51] Int. Cl.[4] ..... A43B 5/14; A43B 7/06

[52] U.S. Cl. ..... 36/131; 36/3 R

[58] Field of Search ..... 36/109, 131, 3 R, 3 A, 36/3 B

[56] References Cited

U.S. PATENT DOCUMENTS

| | | | |
|---|---|---|---|
| 556,825 | 3/1896 | King | 36/3 R |
| 1,211,542 | 1/1917 | Carolin | 36/3 A |
| 1,213,941 | 1/1917 | Patrick | 36/3 A |
| 1,259,229 | 3/1918 | Hagstrom | 36/3 A |
| 1,476,127 | 12/1923 | Williams | 36/3 A |
| 2,701,923 | 2/1955 | Toman | 36/3 R |

FOREIGN PATENT DOCUMENTS

| | | | |
|---|---|---|---|
| 88634 | 1/1957 | Norway | 36/3 R |

OTHER PUBLICATIONS

1984 AXO Catalog, AXO s.n.c., pp. 3–12, 18.

*Primary Examiner*—Werner H. Schroeder
*Assistant Examiner*—T. Graveline
*Attorney, Agent, or Firm*—Koppel & Harris

[57] ABSTRACT

A vented motorcycle boot in which air scoops are provided at the upper side and the front of the boot, with air ducts running down along the sides of the boot from the scoops to the ankle area. A cooling flow of air is established through the scoops and ducts to the most sensitive portion of the foot, while the location of the scoops toward the top of the boot minimizes the amount of dirt or water than can enter the ventilation system. The side scoop faces forward and collects relatively large quantities of air, while the front scoop faces toward the side and promotes circulation by either collecting outside air or venting inside air, depending upon the particular construction of the scoop and the riding conditions. Plugs are provided to close off the scoops in case of particularly muddy conditions.

11 Claims, 7 Drawing Figures

Fig.1.
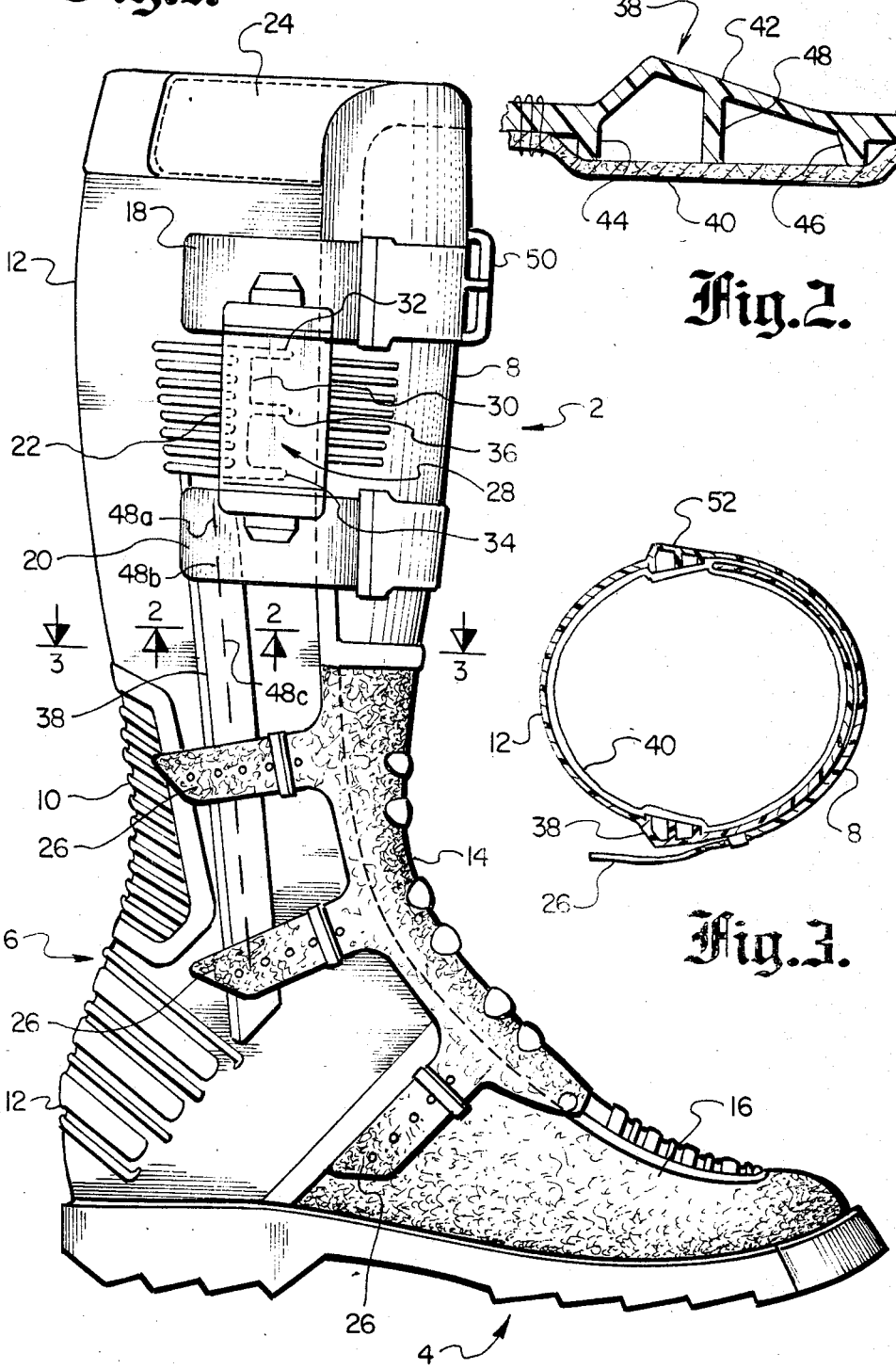
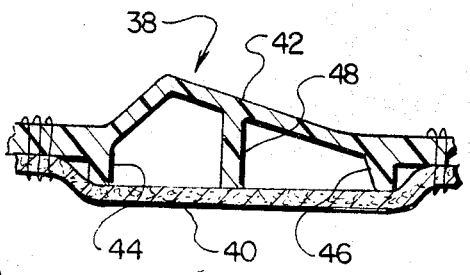
Fig.2.
Fig.3.

VENTED MOTORCYCLE BOOTcl
BACKGROUND OF THE INVENTION

1. Field of the Invention

This invention relates to sportswear, and more particularly to boots specially adapted for motorcycle racing.

2. Description of the Prior Art

Motorcycle racing is a particularly strenuous activity, and is often performed under hot, dusty and generally uncomfortable conditions. Added to this is the fact that the riders' feet are frequently under a great deal of tension from supporting the riders' bodies and a continual shifting of weight back and forth from one foot to the other. With the heavy duty motorcyle boots that are worn for protection, the result is that the interior of the boots become quite hot. This can reduce reacting performance, and create a distraction which is both uncomfortable and unsafe.

It would be desirable to be able to cool the rider's feet inside the boots, particularly under high speed racing conditions. A venting system has been used from certain sports and recreational footwear which could be adapted from motor-cycle boots, but would not provide an ideal solution. This system consists of simple openings or vent holes along the lower sides of the footwear, sometimes with a mesh covering over the opening. While such vents would lead to some introduction of cooling air into the interior of the boot under racing conditions, the cooling effect is not very efficient. Furthermore, since racing often takes place under wet and muddy conditions, water and mud can get inside the boot through the openings and lead to more discomfort than with unvented boots.

SUMMARY OF THE INVENTION

In view of the above problems associated with the prior art, it is an object of the present invention to provide a novel and improved motorcycle boot having a superior venting system for cooling the wearer's feet.

Another object is the provision of a novel and improved vented motorcycle boot which resists the introduction of water and dirt into the interior of the boot.

The present invention accomplishes these and other objects by providing a motorcycle boot with an air venting system designed to bring a constantly replenished circulation of air to the portion of the foot where cooling is maximized, with a construction designed to minimize or entirely eliminate the entry of water and dirt into the boot. One or more air scoops are provided on the upper side of the boot and interconnected with air ducts which extend downward to a lower portion of the boot, preferably near the ankle. Air is forced into the scoops when the rider is in motion, and the ducts transmit the air to where it can cool the foot most efficiently.

Two air scoops are preferably provided, a primary scoop on the outer side of the boot which faces forward and vents into a duct which leads to the outer side of the ankle, and a secondary scoop on the upper front section of the boot which faces towards the side and vents to an air duct which leads to the inner side of the ankle. The scoops and ducts are formed integrally with molded plastic pieces used to form the boot. The ducts consist of channels which overlie an inner boot lining, with a plurality of spaced rib segments extending from the channel wall toward the lining to keep the duct open and minimize disturbance to the air flow. The placement of the air scoops high on the boot tends to keep them free of dirt and water, while the duct outlets at the ankle portion of the boot enhance the cooling effect. The location and orientation of the scoops tends to increase the circulation of the cooling air. A plug can be provided for one or both of the scoops to completely seal them off in case of particularly muddy riding conditions.

These and other features and advantages of the invention will be apparent to those skilled in the art from the following detailed description of a preferred embodiment, taken together with the accompanying drawings, in which:

DESCRIPTION OF THE DRAWINGS

FIG. 1 is a right side elevational view of a motorcycle boot formed in accordance with the invention for the right foot;

FIG. 2 is an enlarged sectional view of the air duct taken along the section line 2–2 of FIG. 1;

FIG 3 is a sectional view taken along the section line 3–3 of FIG. 1;

DETAILED DESCRIPTION OF A PREFERRED EMBODIMENT

Figures 4, 7:
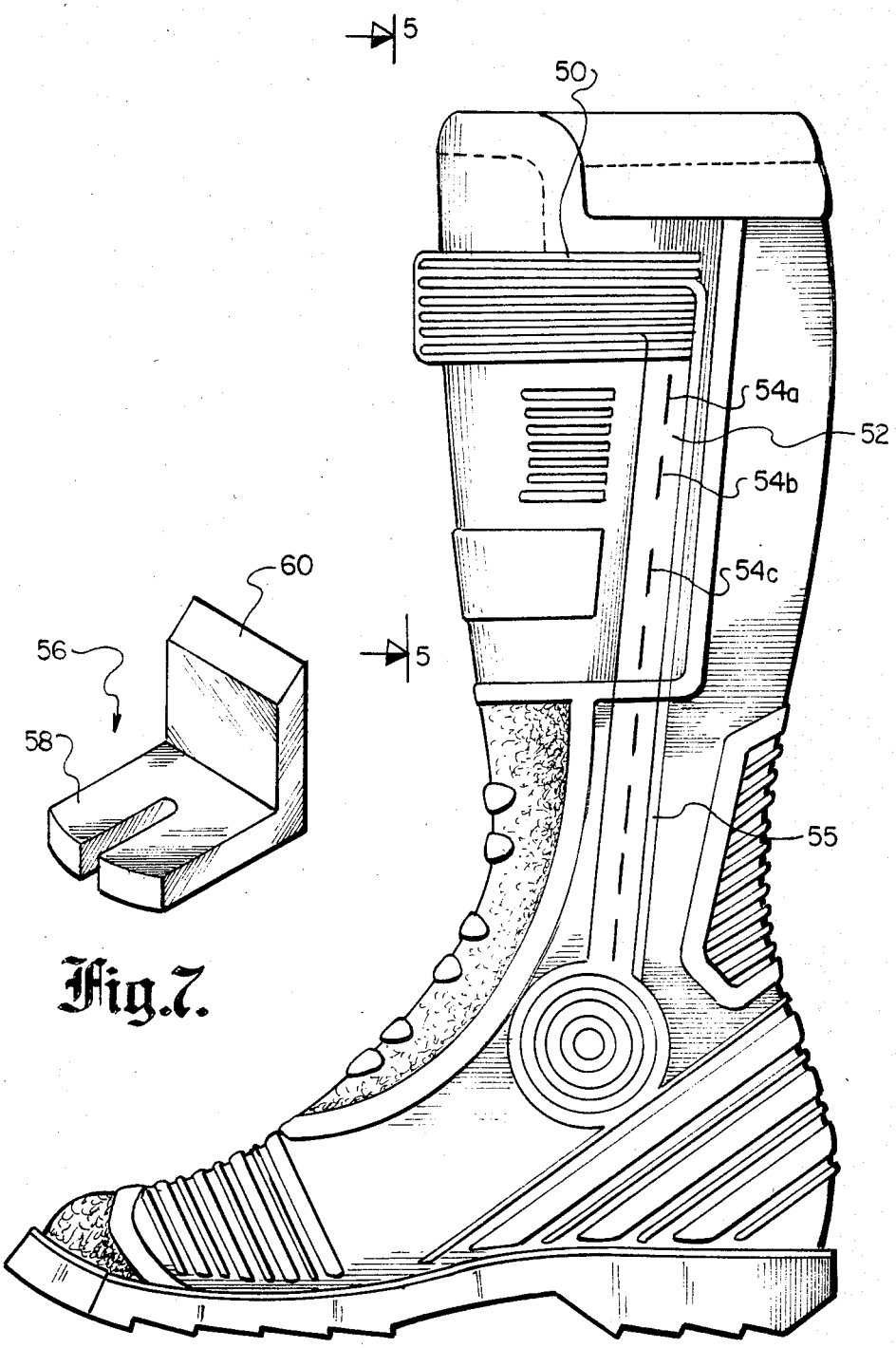
FIG. 4 is a left side elevational view of the boot.
FIG. 7 is a perspective view of a plug which may be used to seal off the boot's air scoops.
Figure 5:
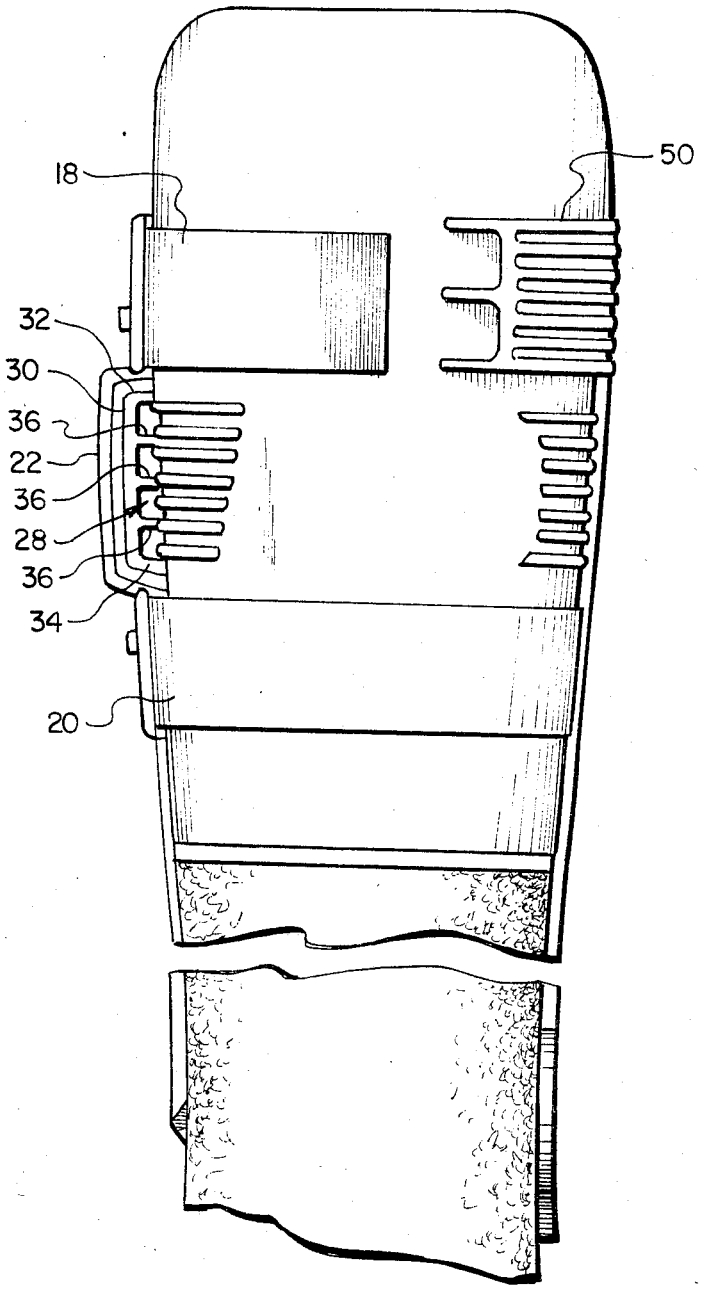
FIG. 5 is a partial front elevational view of the boot.
Figure 6:
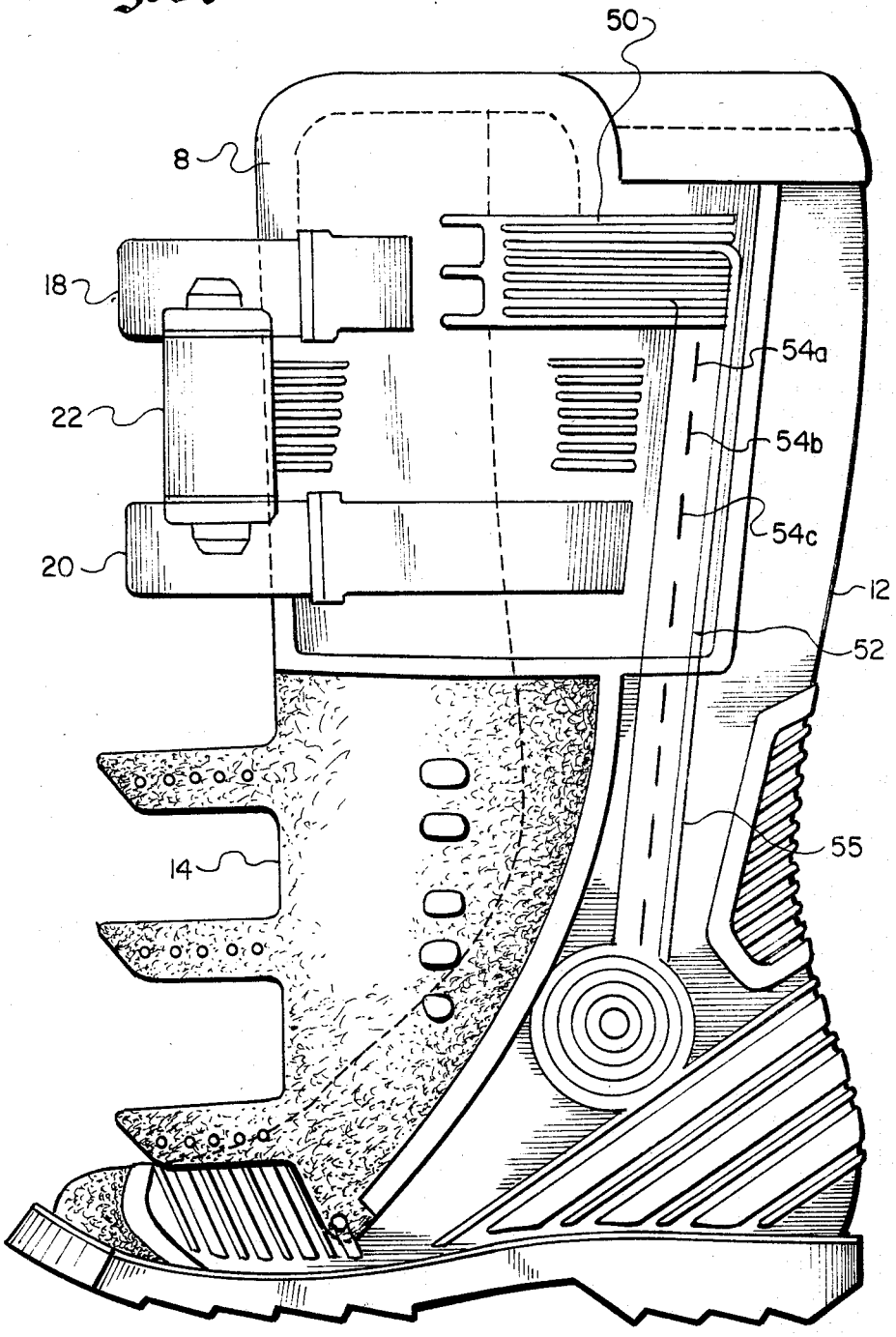
FIG. 6 is a left side elevational view of the boot with the shin guard open.

The overall configuration of the improved motorcycle boot is shown is FIGS. 1, 4 and 6. The boot may be considered to comprise three general areas: an upper leg portion 2, a lower foot portion 4, and an intermediate ankle portion 6. The boot includes three molded sections formed from a strong plastic material, preferably polyeurathane: an upper shin guard 8 at the front of the boot, an upper heel section 10, and a large molded piece 12 which forms the rear of the boot from top to bottom. The buckle portion of boot 14 below the shin guard, as well as the instep 16 are formed from leather or other suitable material.

The shin quard 8 and buckle section 14 are attached along one side to the main boot section 12, permitting them to be flexed to an open position (shown in FIG. 6) at which the wearer can insert or remove his foot. The shin guard includes a pair of straps 18, 20 which extend over the main section of the boot when the shin guard is closed. the undersides of straps 18, 20 are provided with a layer of hook and loop fastener material, similar to a Velcro fastener, which mate with a similar fastening material on the main boot section to hold the shin guard closed. A shield 22 extends between the two shin guard straps to shield an air scoop which provides venting from the boot, as described below. A strip of hook and loop fastener material is also provided along the inner top surface of the shin guard, and mates with a similar strip of hook and loop fastener material 24 which extends along the top of the main boot section. To further assist in holding the boot closed, a plurality of straps 26 extend to the side from the leather buckle section 14 and attach to corresponding buckles on the side of the main boot section.

A primary ventilation system for providing an efficient flow of cooling air to the interior of the boot is provided along the outer, or right hand side of the boot. An air scoop 28 is formed along the upper outer side of the boot to take in air as the wearer is carried forward on the motorcycle. The scoop consists of a shaped channel 30 which is molded in one piece with the main boot section 12. Channel 30 extends outward from the side of the boot and faces toward the front, with its open fron end receiving air flowing past the boot. The channel is attached to the remainder of the boot by a pair of upper and lower side flanges 32, 34, respectively, while a plurality of intermediate support ribs 36 extend between the channel and the main section of the boot to provide outward support to keep the channel open.

Air scoop 28 extends backward along the side of the boot to where it meets with an air duct 38 which extends downward along the outer side of the boot to the ankle section. Air duct 38, a cross-section of which is shown in FIG. 2 and 3, is formed by a molded plastic channel which is molded integrally with the main boot section and overlies a leather lining 40 which lines the inside of the boot. Duct 38 includes a shaped outer channel wall 42 having a pair of extension flanges 44, 46 at its opposite ends to space it away from lining 40, and a central section which forms a peak to provide strength and a large air carrying capacity. The main boot section 12 is stitched to the lining 40 on the opposite sides of duct flanges 44 and 46. A central strengthening rib 48, which is molded integrally with the channel wall 42, extends inward from the central portion of the channel wall and abuts against the inner boot lining 40 to strengthen the wall. To enhance the flow of air down the duct, strengthening rib 48 is provided as a series of spaced rib segments 48*a*, 48*b*, 48*c*, etc. (shown in FIG. 1), which extend down the duct. The rib segments are long enough to keep the channel open at all points, and the spacing between adjacent sections is long enough to substantially reduce the resistance to the flow of air down the duct that would be presented by a continuous rib.

Air duct 38 terminates at the ankle portion of the boot, where it opens to the interior of the boot. As the wearer rides the motorcycle, the forward motion of the boot with respect to the surrounding air forces air into scoop 28. This air flows to the back of the scoop and then down air duct 38, from whence it is vented to the inside of the boot near the wearer's ankle. Since a person's blood vessels come quite close to the skin in the vicinity of the ankle, the provision of cooling air to this portion of the foot has a particularly positive cooling effect. At the same time the location of the air scoop at the upper portion of the boot keeps it above much of the dirt and mud on the track, thus preventing clogging of the ventilation system. The forward orientation of the air scoop enhances the collection of large quantities of air; the scoop can be provided with an outward flare at its forward end to further increase the amount of air which is collected and fed down to the ankle area.

A secondary air scoop is provided on the upper front portion of the boot to vent the ankle area on the inner side of the boot. This air scoop takes the form of a channel 50, similar in construction to channel 30 of the outer air scoop 28. Channel 50 is molded integrally with the upper shin guard, and extends laterally from an air outlet at the front of the boot to a downwardly extending secondary air duct 52 on the inner side of the boot. Secondary air duct 52 is similar in construction to primary air duct 38, and also includes a plurality of spaced suuport ribs 54*a*, 54*b*, 54*c*, etc. which extend inwardly from the central portion of the duct channel to keep the duct open, while minimizing the resistance to air flow. The lower portion of the duct comprises a channel 55 which is formed on the main molded boot section 12 immediately below and aligned with the duct channel 52 on the shin guard. Lower channel 55 mates with the upper channel 52 when the shin guard is closed to provide a continuous air duct. The lower end of lower channel 55 vents to the interior of the boot at the inner ankle.

It can be seen from the various figures that the air opening for scoop 50 faces sideways towards the outer side of the boot, rather than towards the front of the boot like side scoop 28. This orientation of secondary scoop 50 results in an air circulation pattern that enhances the cooling effect of the ventilation system. While air will always flow into side scoop 28 and down to the ankle area when the wearer is in forward motion, air can flow either into or out of front scoop 50. Air can flow into the scoop and down to the inner ankle area when the wearer is in forward motion, and the circulate up the inside of the boot and out along the wearer's pant leg. On the other hand, depending upon the riding conditions, the exact configuration of the air opening for scoop 50 and the tightness of the boot, the flow of air past the mouth of the scoop 50 rather than directly into the scoop may produce a partial vacuum which draws air up duct 52 from the interior of the boot and out through the scoop. This latter phenomenon reinforces the cooling effect of the air coming down through primary duct 38, since it reduces the air pressure within the boot and encourages more air to be admitted into primary scoop 28 and air duct 38. Since this increased circulation flows from the wearer's outer ankle past the inner angle, it can be seen that the air flow has been directed past that portion of the wearer's foot where it will have the greatest cooling effect.

While the placement of the primary and secondary air scoops toward the top of the boot tends to reduce the amount of dirt or water that can enter the ventilation system, under particularly muddy conditions it is still possible for one or both of the scoops or ducts to become clogged. For such conditions a pair of plugs such as that illustrated in FIG. 7 may be provided to close off the scoops. The plug 56, which is adapted particularly for the frontal scoop 50, comprises a chock 58 which is sized to fit snugly into the end of air scoop 50, and an upstanding tab 60 which facilitates insertion and removal of the plug. Chock 58 may have a slight wedge shape so that it is securely retained when inserted into the scoop. A similar plug is provided for the side scoop 28. The plugs are typically used under wet conditions in which the need for auxiliary cooling is considerably less than with dry conditions, and can be easily removed under drier conditions by grasping tab 60 and pulling outward to re-engage the ventilation system.

While a particular embodiment of the invention has been shown and described, various modifications and alternate embodiments will occur to those skilled in the art. Accordingly, it is intended that the invention be limited only in terms of the appended claims.

I claim:

1. In a motorcycle boot having an outer wall, a lower foot portion, an upper leg portion and an intermediate ankle portion, the improvement comprising:

a generally forward facing air scoop extending outwardly from the outer boot wall and adapted to collect air when the wearer is riding forward on a motorcycle, the scoop cooperating with the exterior of the outer boot wall to form a generally rearward directed air channel for incoming air, and an air duct connecting the rearward portion of the air scoop channel to the interior of the boot for transmitting air collected by the scoop to the boot interior, and thereby cooling the wearer's foot.

2. The motorcycle boot of claim 1, the air scoop being located on the upper leg portion of the boot, and the air duct extending downwardly from the channel.

3. The motorcycle boot of claim 2, the boot having an inner lining contacting the outer boot wall around at least most of the periphery of the boot, and a molded plastic channel overlying the lining to form said air duct, said air duct channel comprising a portion of the outer boot wall and including a shaped outer channel wall and a plurality of spaced rib segments extending from the channel wall toward the lining to keep the duct open.

4. The motorcycle boot of claim 2, wherein the air duct terminates at the ankle portion of the boot.

5. The motorcycle boot of claim 4, the air duct terminating on the outer side ankle portion of the boot, and further comprising a second air scoop located on the upper leg portion of the boot and extending outwardly from the outer boot wall, the second scoop cooperating with the exterior of the outer boot wall to form a generally laterally directed air channel, and a second air duct extending generally downwardly from the laterally directed channel and terminating at the interior of the boot on the inner side ankle portion thereof, the second air duct transmitting air between the second scoop and the interior of the boot to further cool the wearer's foot.

6. The motorcycle boot of claim 5, the boot having an inner lining contacting the outer boot wall around at least most of the periphery of the boot, said air ducts comprising molded plastic channels with shaped outer channel walls overlying the lining and forming a portion of the outer boot wall.

7. The motorcycle boot of claim 6, said channels each including a plurality of spaced rib segments extending from the channel wall toward the lining to keep the duct open.

8. In a motorcycle boot having an outer wall, a lower foot portion, an upper leg portion and an intermediate ankle portion, the improvement comprising:

a generally forward facing primary air scoop extending outwardly from the upper outer boot wall on the side of the boot and adapted to collect air when the wearer is riding forward on a motorcycle, the primary scoop cooperating with the exterior of the outer boot wall to form a generally rearward directed air channel for incoming air, a generally downward directed primary air duct connecting the rearward portion of the primary air scoop channel to the interior of the boot, said air duct transmitting air collected by the scoop to the boot interior to cool the wearer's foot, a secondary air scoop extending outwardly from the outer boot wall on the upper front portion of the boot and directed generally toward the side of the boot, the second scoop cooperating with the exterior of the outer boot wall to form a generally laterally directed secondary air channel, and a generally downward directed secondary air duct connecting the secondary air scoop channel to the interior of the boot, said secondary air duct transmitting air between the interior of the boot and the secondary scoop in accordance with the pressure differential between those locations to further cool the wearer's foot.

9. The motorcycle boot of claim 8, said primary and secondary air ducts terminating at the interior of the boot on the outer and inner sides of the ankle portion, respectively.

10. The motorcycle boot of claim 8, said boot having an inner lining contacting the outer boot wall around at least most of the periphery of the boot, the primary air scoop and duct being formed from a unitary piece of molded plastic attached to the outer surface of the lining, said primary air duct comprising a channel forming a portion of the outer boot wall and having shaped walls which together with the adjacent lining form the duct.

11. The motorcycle boot of claim 8, said boot having a front shin guard formed from a first unitary piece of molded plastic material, said shin guard being flexible to allow the boot to be put on or removed, said secondary air scoop and a first adjacent portion of the secondary air duct being formed integrally with the shin guard, said boot including a second unitary piece of molded plastic material on the side of the boot adjacent the shin guard, the second piece extending over the inner side of the ankle portion, the remaining portion of the secondary air duct being formed integrally with the second molded plastic piece and extending from a position mating with the first portion of the air duct at one end of the secondary air duct, to the interior of the boot on the inner side of the ankle portion at the other end of the secondary air duct, said first and second molded plastic pieces being coupled together and forming a portion of the outer boot wall.

* * * * *